US006200230B1

(12) United States Patent
Maruko

(10) Patent No.: US 6,200,230 B1
(45) **Date of Patent: *Mar. 13, 2001**

(54) GOLF BALL AND METHOD OF MANUFACTURING THE SAME

(75) Inventor: Takashi Maruko, Saitama (JP)

(73) Assignee: Bridgestone Sports Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/151,021

(22) Filed: Sep. 10, 1998

(30) Foreign Application Priority Data

Oct. 9, 1997 (JP) ..... 9-245234

(51) Int. Cl.[7] ..... A63B 37/08

(52) U.S. Cl. ..... 473/354; 473/376

(58) Field of Search ..... 473/354, 376

(56) References Cited

U.S. PATENT DOCUMENTS 5,919,100 * 7/1999 Boehm et al. ..... 473/376
5,997,416 * 7/1998 Maruko .

FOREIGN PATENT DOCUMENTS 2-279177 11/1990 (JP) .

* cited by examiner

*Primary Examiner*—Benjamin H. Layno
*Assistant Examiner*—Vishu Mendiratta
(74) *Attorney, Agent, or Firm*—Sughrue, Mion, Zinn, Macpeak & Seas, PLLC

(57) ABSTRACT

A golf ball includes a liquid core, an outer-layer core formed to enclose the liquid core, and a cover formed to cover the outer-layer core. The liquid core is formed of a hollow sphere which contains a liquid therein. The hollow sphere is formed of a resin having an Izod impact resistance of 50 J/m or more and a wall thickness of 0.5–2.5 mm. The outer-layer core is formed of a vulcanized rubber and has a wall thickness of 7–11 mm. The golf ball provides soft hit feel and has excellent travel performance such as flat trajectory and extended run. Also, the golf ball of the present invention has excellent resilience and improved durability.

7 Claims, 1 Drawing Sheet

GOLF BALL AND METHOD OF MANUFACTURING THE SAME

BACKGROUND OF THE INVENTION

1. Field of the Invention

The present invention relates to a golf ball containing a liquid therein and to a method of manufacturing the golf ball.

2. Related Art

A golf ball containing a liquid therein has been known, as disclosed in Patent Publication No. JP-A-90-279177. The golf ball disclosed in this publication includes a spherical hollow shell formed of a polymer material such as thermoplastic resin, and a single liquid core contained in the shell. In this golf ball, the liquid core has a diameter of about 21.8 to about 36.3 mm, and the spherical shell has a wall thickness of about 1.5 to about 10.4 mm.

The golf ball disclosed in the Publication No. JP-A-90-279177 has a spherical hollow shell formed of a polymer material and a liquid contained in the shell. The present inventors found that, when a golf ball is manufactured through mere charging of a liquid into a spherical hollow shell, the golf ball may fail to attain sufficient resilience and durability.

SUMMARY OF THE INVENTION

The present invention has been achieved based on the above-mentioned finding. An object of the present invention is to provide a golf ball which encloses a liquid therein, and which has excellent resilience and increased durability. Another object of the present invention is to provide a method of manufacturing the golf ball.

To achieve the above objects, the present invention provides a golf ball that includes a liquid core, an outer-layer core formed to enclose the liquid core, and a cover formed to cover the outer-layer core. The liquid core is formed of a hollow sphere which contains a liquid therein. The hollow sphere is formed of a resin having an Izod impact resistance of 50 J/m or more and a wall thickness of 0.5–2.5 mm. The outer-layer core is formed of a vulcanized rubber and has a wall thickness of 7–11 mm.

In the golf ball according to the present invention, since the liquid enclosed in the golf ball (as the central portion thereof) has no rigidity, a contact area through which the face of a club comes into contact with the golf ball upon impact increases. As a result, the golf ball according to the present invention provides soft feel upon being hit (hereinafter called "soft hit feel"), and has excellent travel performance such as flat trajectory and extended run. Also, since the outer-layer core made of a vulcanized rubber and having a wall thickness of 7–11 mm is formed around the liquid core, the golf ball has excellent resilience. Moreover, a liquid is charged into the hollow sphere made of a resin having an Izod impact resistance of 50 J/m or more and a wall thickness of 0.5–2.5 mm in order to form the liquid core. With this structure, the outer-layer core is reinforced from the inside by means of the hollow sphere, resulting in an increased impact resistance of the outer-layer core. Consequently, breakage of the outer-layer core is presented, which would otherwise occur due to an impact acting on the golf ball when hit, whereby the durability of the golf ball is improved.

DESCRIPTION OF THE PREFERRED EMBODIMENT

Figure 1:
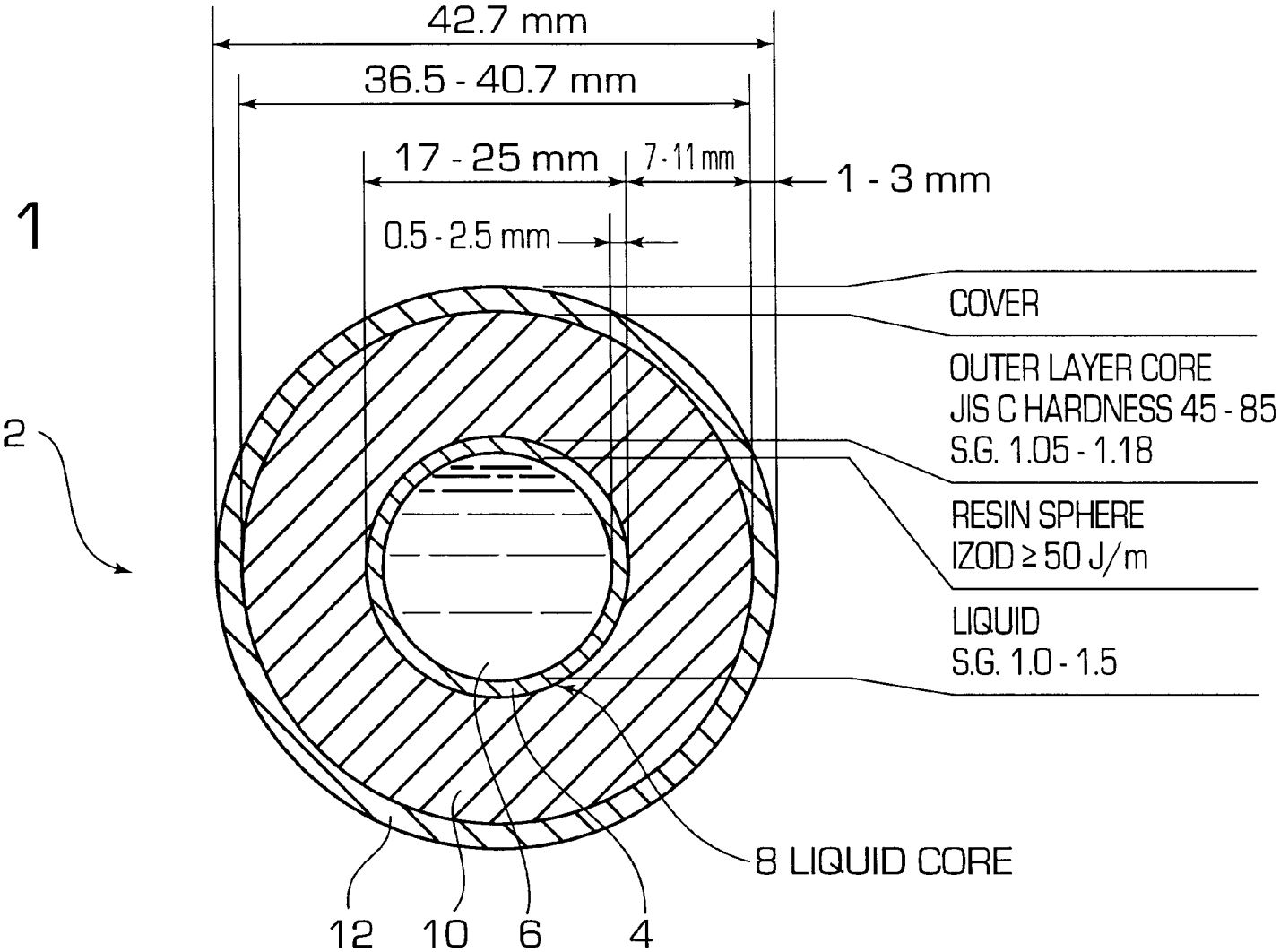
FIG. 1 is a sectional view showing a golf ball according to an embodiment of the present invention.

Next will be described the respective parts composing the golf ball, as well as a method for manufacturing the golf ball.

Liquid Core

The liquid core used in the present invention includes a hollow sphere which contains a liquid therein. The hollow sphere is formed of a material having an Izod impact resistance of at least 50 J/m, more preferably 100 J/m or more. The Izod impact resistance is measured in accordance with a procedure using an ASTM 256 notch. If the Izod impact resistance of the hollow sphere is less than 50 J/m, the outer-layer core reinforcement effect of the hollow sphere is excessively weak, so that the outer-layer core may break due to an impact acting on the golf ball when hit.

An amorphous resin or a resin having a low crystallinity is preferably used for the hollow sphere because of high impact resistance. Specific examples of resin suitable for the hollow sphere include polyarylate, polycarbonate, polyester elastomer, ionomer resin, polyamide resin, and polyethersulphone.

The resin layer of the hollow sphere has a thickness of 0.5–2.5 mm, preferably 1–2 mm. If the thickness of the resin layer is less than 0.5 mm, the effect of reinforcing the outer-layer core is not obtained to a sufficient degree, with the result that the outer-layer core may break due to an impact acting on the golf ball when hit, whereas if the thickness is more than 2.5 mm, hit feel is impaired.

The resin used for forming the hollow sphere preferably has a Shore D hardness of at least 35, more preferably 40–90. If the Shore D hardness of the resin is less than 35, the effect of reinforcing the outer-layer core is not obtained to a sufficient degree, so that the outer-layer core may break due to an impact acting on the golf ball when hit.

The hollow sphere may be manufactured in accordance with, for example, a method in which a pair of resin-made hemispheric cups are joined to each other; or a method in which a hollow sphere is formed through blow forming. However, the method of manufacturing the hollow sphere is not limited thereto. The hollow sphere may have a single-layer structure made of a single type of material or a multi-layer structure composed of a plurality of layers each made of a different type of material. When the hollow sphere having a multi-layer structure is manufactured, each of the layers is formed of a material having an Izod impact resistance of 50 J/m or more. Further, in order to make the overall hardness of the multi-layered hollow sphere at least 35 (Shore D hardness), each of the layers is formed of a material having a Shore D hardness of 35 or more.

In the present invention, the type of liquid to be contained in the hollow sphere is not particularly limited and there may be used water, or water that contains sodium sulfate ($Na_2SO_4$), barium sulfate ($BaSO_4$), or the like as an agent to adjust specific gravity. The specific gravity of the liquid contained in the hollow sphere is preferably 1.0–1.5.

A liquid may be charged into the hollow sphere as follows: a liquid injection hole is formed in the wall of the hollow sphere; a liquid is charged into the hollow sphere through the liquid injection hole; and the liquid injection hole is plugged up with a resin identical with that forming the hollow sphere. However, the method is not limited thereto.

The liquid core preferably has an outer diameter of 17–25 mm, more preferably 18.5–23.5 mm. If the outer diameter of the liquid core is less than 17 mm, the wall thickness of the outer-layer core must be increased, so that hit feel is deteriorated. If the outer diameter of the liquid core is more than 25 mm, the wall thickness of the outer-layer core must be increased, so that the resilience of the golf ball may decrease.

Outer-Layer Core

The material of the outer-layer core is not particularly limited and there may be used vulcanized rubber containing, as a main component, polybutadiene rubber, polyisoprene rubber, natural rubber, silicone rubber, or like rubber. Preferably, vulcanized rubber containing polybutadiene rubber as a main component is used. The outer-layer core may have a single-layer structure made of a single type of material or a multi-layer structure composed of a plurality of layers each made of a different type of material.

The outer-layer core has a wall thickness of 7–11 mm, preferably 8–10 mm. If the wall thickness of the outer-layer core is less than 7 mm, the resilience of the outer-layer core decreases. If the wall thickness of the outer-layer core is more than 11 mm, poor hit feel is imparted. The outer-layer core preferably has an outer-diameter 36.5–40.7 mm, more preferably 38–40 mm.

The outer surface of the outer-layer core preferably has a JIS-C hardness of 45–85, more preferably 55–80. If the hardness of the outer surface is less than 45, the hardness of the outer-layer core becomes insufficient and proper resilience may not be obtained. If the hardness of the outer surface is more than 85, the liquid core does not deform sufficiently, with the result that the effects of the present invention are not obtained to a sufficient degree.

In the golf ball of the present invention, in order to secure the hardness and resilience of the outer-layer core, the material of the outer-layer core preferably has a specific gravity of 1.05–1.18, more preferably 1.06–1.16. If the specific gravity of the material of the outer-layer core is less than 1.05, proper hardness is not obtained. Also, if the specific gravity of the material of the outer-layer core is more than 1.18, resilience is decreased. If the outer-layer core has a multi-layered structure as mentioned above, each of the layers is formed of a material having a specific gravity of 1.05–1.25.

Cover

The material of the cover is not particularly limited and may be selected from the group consisting of ionomer resin, urethane resin, polyester resin, and a mixture of polyurethane resin and polyester resin. The cover preferably has a thickness of 1–3 mm, more preferably 1.5–2.5 mm. The cover may have a single-layered structure made of a single type of material or a multi-layered structure composed of a plurality of layers each made of a different type of material.

Golf Ball

The golf ball of the present invention preferably has hardness such that a load of 100 kg causes a deformation of 2.5–3.5 mm, more preferably 2.6–3.3 mm. If the deformation of the golf ball is less than 2.5 mm, the golf ball is excessively hard and thus poor hit feel may be imparted. If the deformation of the golf ball is more than 3.5 mm, the strength of the golf ball is insufficient, so that the resilience and durability of the golf ball may decrease. The size and weight of the golf ball of the present invention conforms to the Golf Rules. Accordingly, the golf ball is required to have a diameter of 42.67 mm or more and a weight of 45.93 g or less.

Method of Manufacture

The golf ball of the present invention may be manufactured by an arbitrary method. For example, the following steps (1) through (4) may be advantageously employed. In the method of manufacturing the golf ball of the present invention, the golf balls providing the above-mentioned action and effects can be manufactured easily.

(1) A hollow sphere is molded from a resin and a liquid is then charged into the hollow sphere as mentioned above, to thereby form a liquid core.

(2) A pair of like hemispheric cups are molded from unvulcanized rubber for forming an outer-layer core. The two hemispheric cups are subjected to primary vulcanization (semi cure).

(3) The two hemispheric cups which have undergone primary vulcanization are placed on the hollow sphere of the liquid core in such a manner that the cups enclose the hollow sphere. Next, the hemispheric cups are subjected to secondary vulcanization (full cure) so that the hemispheric cups adhere to each other, to thereby form the outer-layer core around the hollow sphere.

(4) A cover is formed on the outer-layer core through compression or injection molding, during which dimples are formed on the cover. The golf ball is then finished as desired through processing such as coating or mark-stamping.

Steps other than the steps (2) and (3) may be employed in order to apply an outer-layer core on the outer surface of a hollow sphere. In any case, an outer-layer core may be applied on the outer surface of a hollow sphere via an adhesive or coupling agent in order to firmly join the outer-layer core onto the outer surface of the hollow sphere. Thus, the outer-layer core reinforcement effect of the hollow sphere is enhanced. For example, in step (3), an adhesive may be applied on the outer surface of the hollow sphere of the liquid core before the two hemispheric cups that have undergone the primary vulcanization are placed on the hollow sphere.

Alternatively, without use of an adhesive, firm adherence between the hollow sphere and the outer-layer core may be established through physically roughening the outer surface of the hollow sphere. In this case where the surface roughness of the outer surface of the hollow sphere is increased instead of adhesive being used, the surface roughness of the resin layer is made to a level of MR-5 or higher as measured in accordance with "Comparison Method for Surface Roughness of Plastic (JIS-k-7104)."

In an exemplary case where in the above-described step (3) hemispheric cups put on a hollow sphere are subjected to vulcanization to thereby form a outer-layer core around the hollow sphere, a peroxide having a low decomposition temperature is preferably used as a vulcanizing agent to be incorporated in a rubber composition for forming the hemispheric cups. The reason is as follows. In the case where hemispheric cups placed on a hollow sphere are subjected to vulcanization at a high vulcanizing temperature, there is a danger of explosion of a hollow sphere due to boiling of the liquid contained therein. However, when the vulcanizing temperature is lowered by use of a peroxide having a low decomposition temperature, proper, effective vulcanization can be performed, while the above-mentioned explosion of the hollow sphere due to boiling of the liquid contained therein is prevented, in order to obtain an outer-layer core having a sufficient strength. The most preferable vulcanizing agent for this purpose is a vulcanizing agent which contains, in an amount of 30%, a peroxide having a one-minute half value temperature of 155° C. or less. The term "one-minute half value temperature" means the lowest temperature at which one-half of the incorporated peroxide is decomposed within one minute. More specific examples of such a vulcanizing agent include 1,1-bis(tert-buthylperoxy)-3,3,5-trimethylcyclohexane (such as Perhexa 3M manufactured by MOF Corp.), 2,5-dimethyl-2,5-di(benzoylperoxy)hexane (such as Perhexa 25Z manufactured by MOF Corp.), and benzoylperoxide (such as Nyper BO manufactured by MOF Corp.).

In order to conduct proper vulcanization for manufacturing an outer-layer core having a sufficient strength, while preventing explosion of a hollow sphere during vulcanization due to boiling of the liquid contained therein, there may be advantageously used, as a liquid to be contained in the hollow sphere, a high-boiling-point liquid such as water that contains sodium sulfate or the like for increasing boiling point. Employing this kind of liquid enables use of a vulcanizing agent having a somewhat high vulcanizing temperature.

As shown in FIG. 1, a golf ball 2 according to the present embodiment includes a liquid core 8 comprising a resin-made hollow sphere 4 which contains a liquid 6 therein, an outer-layer core 10 formed on the outer surface of the liquid core 8, and a cover 12 formed on the outer surface of the outer-layer core 10.

The resin-made hollow sphere 4 is formed of a resin having an Izod impact resistance of 50 J/m or more. The resin-made hollow sphere 4 has a thickness a of 0.5–2.5 mm and an outer diameter b of 17–25 mm. The outer-layer core 10 is formed of vulcanized rubber, and has a wall thickness c of 7–11 mm and an outer diameter d of 36.5–40.7 mm. The thickness e of the cover 12 is 1–3 mm. The outer diameter f of the golf ball is about 42.7 mm.

The golf ball of the present embodiment was manufactured according to the following steps. First, a resin-made hollow sphere 4 was formed. A liquid injection hole was then formed in the wall of the resin-made hollow sphere 4. A liquid was charged into the resin-made hollow sphere 4 through the liquid injection hole. Then, the liquid injection hole was plugged up with a resin identical with that forming the resin-made hollow sphere 4, to thereby form a liquid core 8. Meanwhile, a pair of like hemispheric cups were molded through use of unvulcanized rubber for forming an outer-layer core 10. The two hemispheric cups were subjected to primary vulcanization (semi cure). Subsequently, an adhesive was applied on the outer surface of the resin-made hollow sphere 4, and the two semi-cured hemispheric cups were then placed on the resin-made hollow sphere 4 in such a manner that the cups enclosed the resin-made hollow sphere 4. Next, the hemispheric cups were subjected to secondary vulcanization (full cure), so that the hemispheric cups became adhered to each other, to thereby form the outer-layer core 10 around the resin-made hollow sphere 4. Thereafter, through compression molding, a cover 12 was formed on the outer-layer core 10, and dimples were formed thereon.

EXAMPLES

A golf ball shown in FIG. 1 was manufactured according to the aforementioned method. Respective golf balls of Examples and Comparative Examples shown in Table 4 were manufactured by use of outer-layer cores, resin-made hollow spheres, and covers having compositions shown in Tables 1, 2, and 3, respectively. Examples 1–6 and Comparative Examples 1–5 are golf balls each including a liquid core comprising a resin-made hollow sphere which contains a liquid therein; a outer-layer core formed on the outer surface of the liquid core; and a cover formed on the outer surface of the outer-layer core. Comparative Example 6 is a conventional two-piece golf ball having a single-layer solid core. Therefore, with regard to Comparative Example 6, the properties of the solid core are shown in the row for the outer-layer core in Table 4.

TABLE 1

Composition of Outer-Layer Core

| | Composition (wt. %) | | | | |
|---|---|---|---|---|---|
| | A | B | C | D | E |
| Polybutadiene rubber | 100.0 | 100.0 | 100.0 | 100.0 | 100.0 |
| Zinc oxide | 7.0 | 7.0 | 7.0 | 10.0 | 10.0 |
| Zinc acrylate | 33.0 | 33.0 | 33.0 | 33.0 | 28.0 |
| Barium sulfate | 9.7 | — | 7.0 | 12.4 | 14.6 |
| Cross linking agent A | 0.4 | 0.4 | 0.4 | 0.4 | 0.6 |
| Cross linking agent B | 0.8 | 0.8 | 0.8 | 0.8 | 0.6 |
| JIS-C hardness (surface hardness) | 79 | 79 | 80 | 80 | 80 |

Polybutadiene rubber: JSR BR01

Cross linking agent A: Dicumyl peroxide (Percumyl D manufactured by NOF Corp.)

Cross linking agent B: 1,1-bis(tert-buthylperoxy)-3,3,5-trimethylcyclohexane (Perhexa 3M manufactured by NOF Corp.)

TABLE 2

Composition of Resin of Resin-made hollow sphere

| | Composition (wt. %) | | |
|---|---|---|---|
| | F | G | H |
| Polyarylate | 100.0 | — | — |
| Polyester | — | 100.0 | — |
| Polypropylene | — | — | 100.0 |
| Shore D hardness | 90 | 40 | 79 |
| Melting point (° C.) | 230 | 172 | 160 |
| Izod impact resistance (J/m) | 108 | No Destruction | 39 |

Polyarylate: U-Polymer (U-8000) manufactured by Unitika, Ltd.

Polyester: Hitrel 2474B manufactured by Du Pont-Toray Co., Ltd.

Polypropylene: Polypro E-200G manufactured by Idemitsu Petrochemical Co., Ltd.

Melting point: measured by DSC

TABLE 3

Composition of Cover

| | Composition (wt. %) I |
|---|---|
| Ionomer resin A | 50.0 |
| Ionomer resin B | 50.0 |
| Titanium dioxide | 5.2 |
| Magnesium stearate | 1.2 |
| Shore D hardness | 62 |

Ionomer resin A: Himilan 1605 manufactured by Du Pont-Mitsui Polychemicals Co., Ltd.

Ionomer resin B: Himilan 1706 manufactured by Du Pont-Mitsui Polychemicals Co., Ltd.

TABLE 4

(1/2: Examples)

| | | Example 1 | Example 2 | Example 3 | Example 4 | Example 5 | Example 6 |
|---|---|---|---|---|---|---|---|
| Liquid core | Resin composition | F | F | F | G | G | G |
| | Outer diameter(mm) | 23.1 | 19.1 | 23.1 | 23.1 | 23.1 | 23.1 |
| | Resin thickness(mm) | 1.0 | 1.0 | 0.5 | 2.0 | 1.0 | 1.0 |
| | Resin weight(g) | 1.9 | 1.3 | 1.0 | 3.3 | 1.8 | 1.8 |
| | Liquid composition | Aqueous $Na_2SO_4$ solution | Aqueous $Na_2SO_4$ solution | Aqueous $Na_2SO_4$ solution | Aqueous $Na_2SO_4$ solution | Aqueous $Na_2SO_4$ solution | Aqueous $BaSO_4$ solution |
| | Liquid weight(g) | 5.7 | 3.0 | 6.6 | 4.2 | 5.7 | 7.3 |
| Outer-layer core | Composition | A | A | A | A | A | B |
| | Outer diameter(mm) | 39.1 | 39.1 | 39.1 | 39.1 | 39.1 | 39.1 |
| | Thickness(mm) | 8.0 | 10.0 | 8.0 | 8.0 | 8.0 | 8.0 |
| | Weight(g)*1 | 36.1 | 35.9 | 36.0 | 35.9 | 35.9 | 36.2 |
| | Specific gravity | 1.145 | 1.145 | 1.145 | 1.145 | 1.145 | 1.090 |
| Cover | Composition | I | I | I | I | I | I |
| | Thickness(mm) | 1.8 | 1.8 | 1.8 | 1.8 | 1.8 | 1.8 |
| Ball | Outer diameter(mm) | 42.7 | 42.7 | 42.7 | 42.7 | 42.7 | 42.7 |
| | Weight(g) | 45.2 | 45.1 | 45.2 | 45.1 | 45.1 | 45.3 |
| | Hardness(mm)*2 | 3.1 | 2.7 | 3.3 | 2.6 | 3.4 | 3.2 |
| Durability(W#1 HS45) | | 0/10 | 0/10 | 0/10 | 0/10 | 0/10 | 0/10 |
| Distance test: | Launch angle(°) | 12.2 | 12.3 | 12.1 | 12.3 | 12.1 | 12.0 |
| W#1 HS45 | Carry(m) | 209.3 | 210.0 | 207.3 | 210.7 | 207.9 | 209.8 |
| | Total(m) | 228.5 | 231.9 | 227.2 | 229.6 | 227.5 | 233.4 |
| Distance test: | Launch angle(°) | 13.1 | 13.0 | 12.9 | 13.1 | 13.0 | 12.8 |
| W#1 HS40 | Carry(m) | 181.3 | 178.8 | 184.6 | 180.7 | 183.7 | 177.5 |
| | Total(m) | 197.2 | 198.3 | 197.0 | 197.6 | 197.9 | 200.1 |
| Hit feel | | Excellent | Excellent | Excellent | Excellent | Excellent | Good |

*1 Examples 1–6 and Comparative Example 1–5: Weight including the weight of the liquid core
Comparative Example 1–5: Weight of the solid core
*2 Deformation amount of the golf ball under a load of 100 kg

TABLE 4

(2/2: Comparative Examples)

| | | Comp. Ex.1 | Comp. Ex.2 | Comp. Ex.3 | Comp. Ex.4 | Comp. Ex.5 | Comp. Ex.6 |
|---|---|---|---|---|---|---|---|
| Liquid core | Resin composition | F | F | F | G | H | — |
| | Outer diameter(mm) | 23.1 | 19.1 | 13.1 | 29.1 | 23.1 | — |
| | Resin thickness(mm) | 5.0 | 0.3 | 1.0 | 1.0 | 1.0 | — |
| | Resin weight(g) | 6.7 | 0.4 | 0.6 | 2.9 | 1.4 | — |
| | Liquid composition | Aqueous $Na_2SO_4$ solution | Aqueous $Na_2SO_4$ solution | Aqueous $Na_2SO_4$ solution | Aqueous $Na_2SO_4$ solution | Aqueous $Na_2SO_4$ solution | — |
| | Liquid weight(g) | 1.4 | 3.9 | 0.8 | 12.2 | 5.7 | — |
| Outer-layer core | Composition | C | A | A | A | D | E |
| | Outer diameter(mm) | 39.1 | 39.1 | 39.1 | 39.1 | 39.1 | 38.7 |
| | Thickness(mm) | 8.0 | 10.0 | 13.0 | 5.0 | 8.0 | — |
| | Weight(g)*1 | 36.1 | 35.9 | 35.8 | 36.1 | 35.9 | 35.1 |
| | Specific gravity | 1.130 | 1.145 | 1.145 | 1.145 | 1.160 | 1.160 |
| Cover | Composition | I | I | I | I | I | I |
| | Thickness(mm) | 1.8 | 1.8 | 1.8 | 1.8 | 1.8 | 2.0 |
| Ball | Outer diameter(mm) | 42.7 | 42.7 | 42.7 | 42.7 | 42.7 | 42.7 |
| | Weight(g) | 45.2 | 45.1 | 45.0 | 45.2 | 45.1 | 45.3 |
| | Hardness(mm)*2 | 2.4 | 3.5 | 2.6 | 3.4 | 3.2 | 3.3 |
| Durability(W#1 HS45) | | 0/10 | 8/10 | 0/10 | 0/10 | 7/10 | 0/10 |
| Distance test: | Launch angle(°) | 12.3 | — | 12.1 | 10.5 | — | 12.2 |
| W#1 HS45 | Carry(m) | 210.2 | — | 207.6 | 196.2 | — | 208.2 |
| | Total(m) | 226.3 | — | 225.3 | 213.4 | — | 226.7 |
| Distance test: | Launch angle(°) | 13.2 | — | 13.1 | 11.2 | — | 13.0 |
| W#1 HS40 | Carry(m) | 186.2 | — | 185.5 | 175.8 | — | 185.2 |
| | Total(m) | 196.3 | — | 196.5 | 182.8 | — | 196.8 |
| Hit feel | | Bad | — | Bad | Good | — | Bad |

*1 Examples 1–6 and Comparative Example 1–5: Weight including the weight of the liquid core
Comparative Example 1–5: Weight of the solid core
*2 Deformation amount of the golf ball under a load of 100 kg In Tables 1–3, JSR-BRO1 (The Japan Synthetic Rubber Co., Ltd.) was used as polybutadiene rubber; Dicumyl peroxide (Perucumyl D manufactured by NOF Corp.) was used as cross linking agent A; 1,1-bis(tert-buthylperoxy)-3, 3,5-trimethylcyclohexane (Perhexa 3M manufactured by NOF Corp.) was used as cross linking agent B; U-Polymer (U-8000) (Unitika, Ltd.) was used as polyarylate; Hitrel 2474B (Du Pont-Toray Co., Ltd.) was used as polyester; Polypro E-200G (Idemitsu Petrochemical Co., Ltd.) was used as polypropylene; Himilan 1605 (Du Pont-Mitsui Polychemicals Co., Ltd.) was used as ionomer resin A; Himilan 1706 (Du Pont-Mitsui Polychemicals Co., Ltd.) was used as ionomer resin B. The Izod impact resistance of the polyarylate was 108 J/m, and that of the polypropylene was 39 J/m. The polyester was not destroyed in an impact resistance test. The aqueous $Na_2SO_4$ solution shown in table 4 is an aqueous solution of 18 wt. % $Na_2SO_4$. The composition of the aqueous $BaSO_4$ solution shown in table 4 is as follows: water: 100 parts by weight, barium sulfate: 100 parts by weight, carboxymethylcellulose: 6 parts by weight, dodecylbenzenesulfonic acid: 4 parts by weight.

In manufacture of the golf balls of Examples 1–6 and Comparative Examples 1–5, the hemispheric cups were subjected to primary vulcanization at 120° C. for 12 minutes and to secondary vulcanization at 155° C. for 15 minutes. In manufacture of the conventional two-piece golf balls of Comparative Example 6, the solid cores were subjected to vulcanization at 155° C. for 15 minutes.

The golf balls of Examples and Comparative Examples were measured for their hardnesses, subjected to a durability test, a travel distance test, and a hit-feel test. The measurement and tests were performed as follows:

(Hardness of Golf Ball)

The deformation amount of each golf ball was measured under a load of 100 kg.

(Durability Test)

The golf balls of Examples and Comparative Examples were subjected to a durability test. A swing robot manufactured by Miyama Co., Ltd. was used in the durability test. The golf balls were hit at a head speed of 45 m/s (HS45) by J's Metal No.1 Wood (w#1, loft angle: 9.5°) manufactured by Bridgestone Sports Co., Ltd. and visual check was performed to determine whether the balls had been damaged. The durability defective ratio is represented by (Y/X) wherein X (denominator) is the number of hit golf balls and Y (numerator) is the number of golf balls that suffered damage.

(Distance Test)

Through use of a hitting test machine, the golf balls were hit by the No.1 Wood at head speeds of 45 m/s (HS45) and 40 m/s (HS40). The launch angle, carry travel distance, and total travel distance were measured.

(Hit-Feel Test)

The golf balls were subjected to sensory evaluation test for hit feel in which three professional golfers hit the golf balls and evaluated the hit feel. Evaluation criteria for hit feel are as follows:

Excellent: Hit feel is soft and very good.

Good: Hit feel is soft and good

Bad: Hit feel is bad

The results are shown in Table 4. As is apparent from Table 4, the golf balls of Example 1–6 exhibited flat trajectory and extended run, yielded extended travel distance, and provided soft and favorable hit feel, as compared with the conventional two-piece golf balls of Comparative Example 6. Also, the golf balls of Example 1–6 raised no problems in terms of resilience and durability. In contrast, the golf balls of Comparative Example 1 having a resin-made hollow sphere whose wall thickness was excessively large provided poor hit feel, almost all the golf balls of Comparative Example 2 having a resin-made hollow sphere whose wall thickness was excessively small suffered damage with their outer-layer cores cracked, the golf balls of Comparative Example 3 having an outer-layer core whose wall thickness was excessively large provided poor hit feel, the golf balls of Comparative Example 4 having an outer-layer core whose wall thickness was excessively small exhibited lowered resilience and decreased travel distance, almost all the golf balls of Comparative Example 5 having a resin-made hollow sphere formed of a resin having an excessively low Izod impact resistance suffered damage with their outer-layer cores cracked. In the cases of Comparative Examples 2 and 5, the distance test and hit-feel test were not be conducted because of occurrence of damage.

What is claimed is:

1. A golf ball comprising:

a liquid core formed of a hollow sphere and containing a liquid therein, said hollow sphere being formed of a resin having an Izod impact resistance of 50 J/m or more, a Shore D hardness of at least 35 and a wall thickness of 0.5–2.5 mm, said resin being selected from the group consisting of polyarylate, polycarbonate, polyester elastomer, ionomer resin, polyamide resin, and polyether-sulphone, said liquid being selected from the group consisting of water, water that contains sodium sulfate ($Na_2SO_4$), and water that contains barium sulfate ($BaSO_4$), and having a specific gravity of 1.0–1.5;

an outer-layer core formed to enclose the liquid core, the outer-layer core being formed of a vulcanized rubber and having a wall thickness of 7–11 mm; and a cover formed to cover the outer-layer core.

2. A golf ball according to claim 1, wherein the liquid core has an outer diameter of 17–25 mm.

3. A golf ball according to claim 1, wherein the outer surface of the outer-layer core has a JIS-C hardness of 45–85.

4. A golf ball according to claim 1, wherein the outer-layer core has a specific gravity of 1.05–1.18.

5. A golf ball according to claim 1, wherein the cover has a thickness of 1–3 mm.

6. A golf ball according to claim 1, wherein an amount of deformation under a load of 100 kg is 2.5–3.5 mm.

7. A golf ball according to claim 1, wherein an adhesive layer exits between the liquid core and the outer-layer core.

* * * * *